United States Patent [19]

Popper, Jr.

[11] 4,254,929

[45] Mar. 10, 1981

[54] APPARATUS FOR ENABLING MOVEMENT OF A BINDER

[76] Inventor: Robert H. Popper, Jr., 24 Raynold Rd., Mountain Lakes, N.J. 07046

[21] Appl. No.: 11,219

[22] Filed: Feb. 12, 1979

[51] Int. Cl.[3] ..... A47F 7/14

[52] U.S. Cl. ..... 248/447; 312/233

[58] Field of Search ..... 248/447; 297/162; 312/233

[56] References Cited

U.S. PATENT DOCUMENTS

| | | | |
|---|---|---|---|
| 666,674 | 1/1901 | Hoffmann | 248/447 |
| 871,903 | 11/1907 | Work | 248/447 |
| 1,093,220 | 4/1914 | Walsh | 312/233 |
| 1,796,496 | 3/1931 | Volkmar | 312/233 |
| 1,945,661 | 2/1934 | Sithens | 312/233 |
| 2,959,885 | 11/1960 | Upton | 248/447 |
| 3,044,210 | 7/1962 | Upton | 248/447 |
| 3,857,605 | 12/1974 | Fantoni | 297/162 |
| 3,908,954 | 9/1975 | Nix | 248/447 |

*Primary Examiner*—James T. McCall
*Attorney, Agent, or Firm*—Howard N. Sommers

[57] ABSTRACT

An apparatus for enabling movement of a binder between stored and readable positions relative to a support. The apparatus includes means for enabling movement of the binder in a substantially off-horizontal plane relative to the support, and means for enabling movement of the binder in a substantially off-vertical plane relative to the support, connected to the substantially off-horizontal plane movement enabling means. The apparatus further includes means for closing the binder in the substantially off-horizontal plane relative to the support upon completion of storage of the binder. The apparatus still further includes means for stopping movement of the movable plate portion of the substantially off-horizontal movement enabling means upon completion of storage of the binder. The apparatus still further includes means for biasing the covers of the accessed binder relative to the back of the non-accessed binder upon completion of access to such binder.

13 Claims, 6 Drawing Figures

FIG. 1
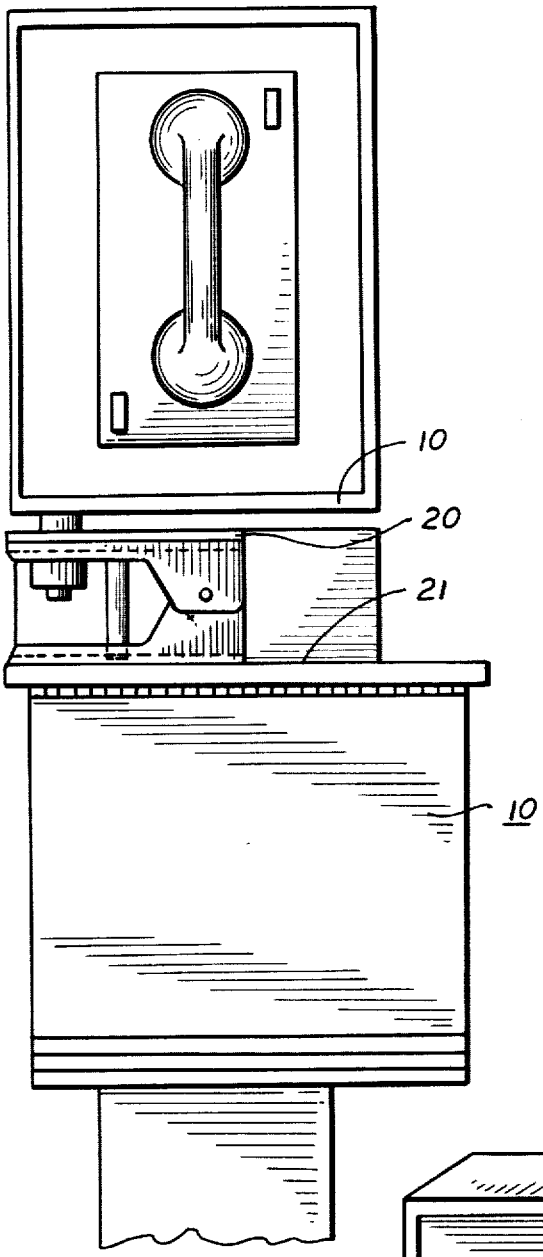
FIG. 2
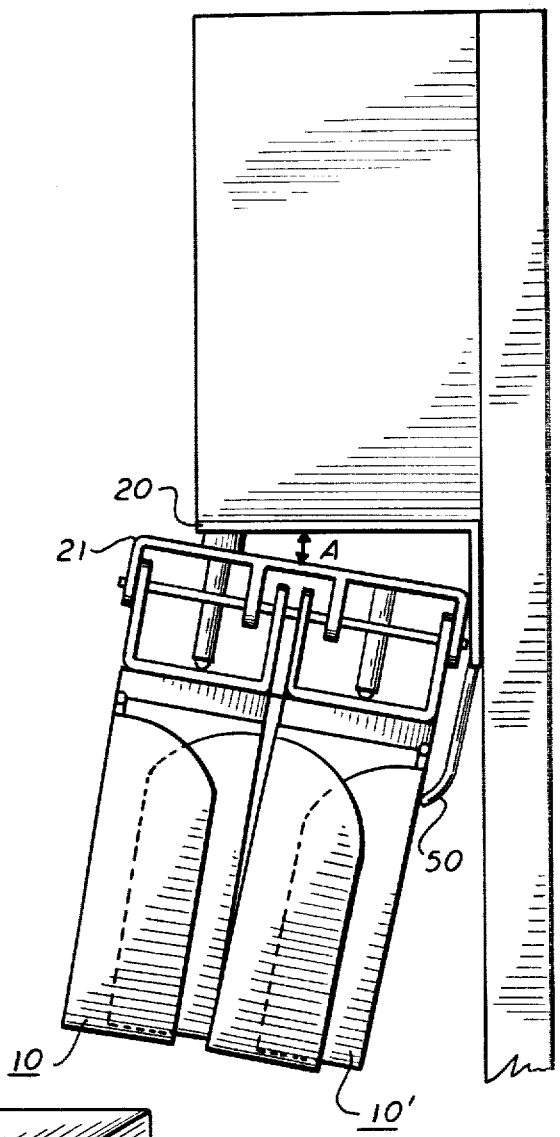
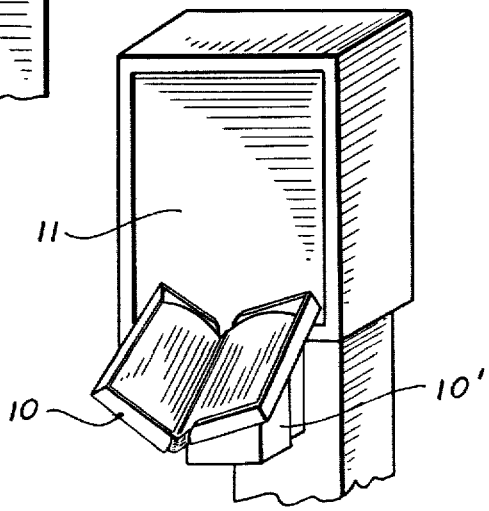
FIG. 3

FIG. 4
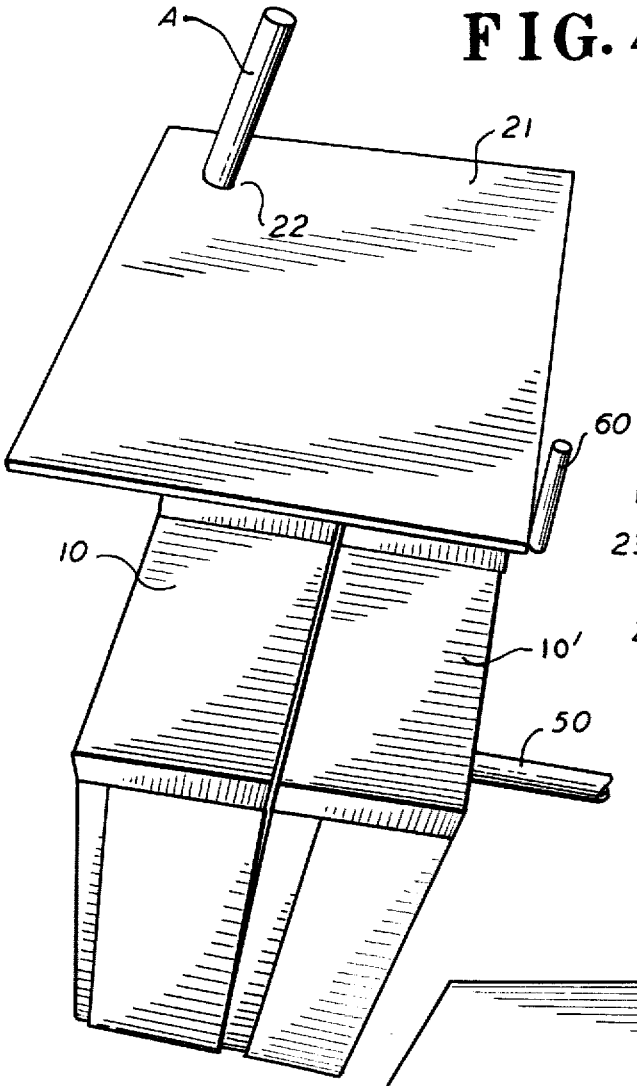
FIG. 5
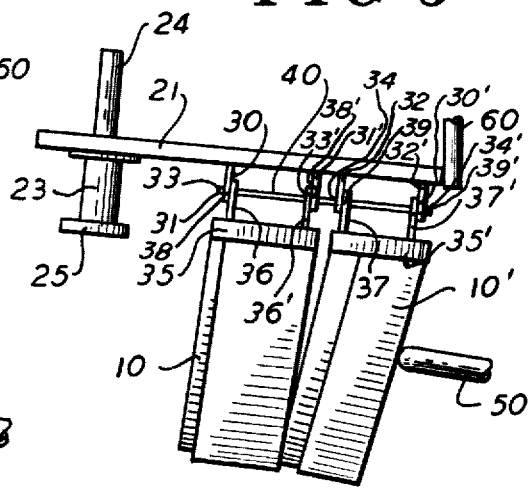
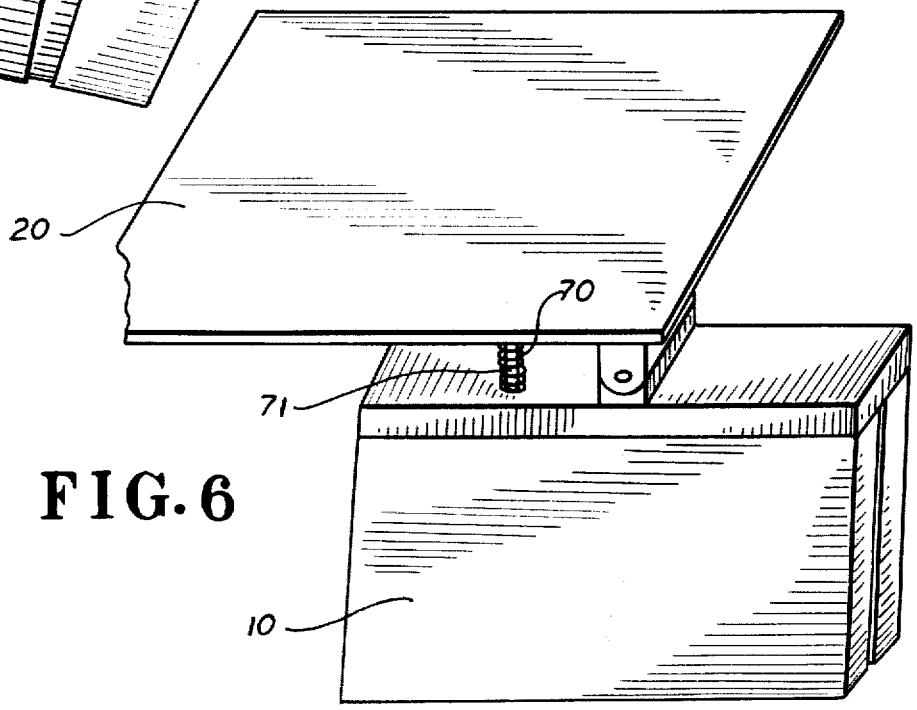
FIG. 6

APPARATUS FOR ENABLING MOVEMENT OF A BINDER

BACKGROUND OF THE INVENTION

The invention relates generally to apparatuses for storage of and access to binders, and specifically to an apparatus for enabling movement of a binder between stored and readable positions relative to a support.

Presently, apparatuses for enabling movement of a binder between stored and readable positions relative to a support are inconvenient and inefficient to operate, expose the contents of the binder in stored position thereof to damage due to vandalism and exposure to weather conditions, do not position the binder in a conveniently accessible position relative to the support upon completion of storage of the binder for convenient accessibility thereto, and generate damage to other non-accessed binders upon completion of access to one such binder by virtue of pressure exerted by the covers of the accessed binder against the back of such other non-accessed binder and upon impact generated by return of the accessed binder to stored position.

SUMMARY OF THE INVENTION

In view of the above, one of the objects of the invention is to provide an apparatus for enabling movement of a binder between stored and readable positions relative to a support, which enables access to and storage of the binder in a convenient and efficient manner, to protect the contents of the binder from damage due to vandalism or exposure thereof to weather conditions, to properly position the binder relative to the support upon completion of storage of the binder for convenient accessibility, and to prevent damage to the covers of accessed binders, and to the accessed binder upon impact thereof upon return to stored position.

The above object, as well as others, are provided for in the invention by means of an apparatus for enabling movement of a binder between stored and readable positions relative to a support, so as to enable access to and storage of the binder, including means for enabling movement of the binder in a substantially off-horizontal plane relative to the support, for initiation of access to and completion of storage of the binder, and means for enabling movement of the binder in a substantially off-vertical plane relative to the support, connected to the substantially off-horizontal plane movement enabling means, for completion of access to and initiation of storage of the binder, which enables access to and storage of the binder in a convenient and efficient manner. The apparatus further includes means for closing the binder in the substantially off-horizontal plane relative to the support upon completion of storage of the binder, so as to protect the contents thereof from damage due to vandalism or exposure thereof to weather conditions. The apparatus still further includes means for stopping movement of the movable plate portion of the substantially off-horizontal movement enabling means upon completion of storage of the binder, which properly position the binder relative to the support upon completion of storage of the binder for convenient accessibility thereto. The apparatus still further includes means for biasing the covers of the accessed binder relative to the back of the non-accessed binder upon completion of access to such binder, so as to prevent damage to such covers of such accessed binder, to absorb the impact of return of the accessed binder to stored position, and further to facilitate return of the accessed binder to stored position.

DESCRIPTION OF DRAWINGS

The invention is illustrated, by way of example, in the accompanying drawings, wherein:

FIG. 1 is a front elevational view of the binder movement enabling apparatus, a pair of binders, and a support therefor, with the binders in stored position, pursuant to the invention;

FIG. 2 is a side elevational view thereof;

FIG. 3 is a front perspective view of the binder movement enabling apparatus, a pair of binders, and a support therefor, with one binder in accessed position pursuant to the invention;

FIG. 4 is a top perspective partly fragmentary view of the binder movement enabling apparatus and a pair of binders pursuant to the invention;

FIG. 5 is a side elevational view thereof; and

FIG. 6 is a side perspective view of a portion of the binder movement enabling apparatus and a binder pursuant to the invention.

DESCRIPTION OF THE PREFERRED EMBODIMENT

The preferred embodiment of the invention, as illustrated in the Figures, comprises, for example, an apparatus for enabling the movement of binders, such as 10, 10', each of which encloses telephone directories therein, between stored and readable positions relative to a support, such as shelf 11 in a pedestal-style telephone booth, so as to enable access to and storage of the binders 10, 10' and the telephone directories enclosed therein.

The apparatus includes means for enabling movement of the binders 10, 10' in a substantially off-horizontal plane relative to the shelf 11, for initiation of access to and completion of storage of the binders 10,10' and the telephone directories enclosed therein, in a convenient and efficient manner, and means for enabling movement of the binders 10, 10' in a substantially off-vertical plane relative to the shelf 11, for completion of access to and initiation of storage of the binders 10, 10' and of the telephone directories enclosed therein, connected to the binder substantially off-horizontal plane movement enabling means.

The substantially off-horizontal movement enabling means include a first plate 20, a second plate 21, and means for connecting the second plate 21 to the first plate 20 in a substantially off-horizontal plane. The first plate 20 is secureable to the shelf 11. The second plate 21 has an opening 22 proximate one corner thereof, and a collar 23 extending about and from the opening 22. The connecting means comprises a rod 24, which extends through the collar 23 and the opening 22 of the second plate 21, secured at one end to the first plate 20 at a generally obtuse included angle "A" therewith, including a base 25 at the other end thereof, of diameter greater than the diameter of the opening 22 in the second plate 21.

The substantially off-vertical movement enabling means include first brackets 30, 30', each generally U-shaped and including end portions 31, 31', 32, 32', having aligned openings 33, 33', 34, 34' therein, secured to the second plate 21 proximate the side edge thereof opposite the corner of the second plate 21 in which the opening 22 is located and second brackets, 35, 35' each generally U-shaped and including end portions 36, 36', 37, 37' having aligned openings 38, 38', 39, 39' therein, each secured to the back portion of one of the binders 10, 10', and a rod 40, which extends through the aligned openings 33, 33', 34, 34', 38, 38', 39, 39' in the end portions 31, 31', 32, 32', 36, 36', 37, 37' of the first brackets 30, 30' and second brackets 35, 35'.

The apparatus further includes means for closing the binders 10, 10' in the substantially off-horizontal plane relative to the shelf 11, upon completion of storage of the binders 10, 10'. The binder closing means comprise a rod 50, secured at one end to plate 20, the opposite end of which extends to a position where the cover of binder 10' is engageable therewith upon movement thereof to stored position.

The apparatus still further includes means for stopping movement of the second plate 21 in the substantially off-horizontal plane relative to the shelf 11, upon completion of storage of the binders 10, 10', so as to properly position the binders 10, 10' relative to the shelf 11 upon completion of storage of the binders 10, 10'. The plate movement stopping means comprise a rubber bunper 60 secured to the plate 20, which extends to a position where it engages the second plate 21 upon movement of the binders 10, 10' to stored position.

The apparatus still further includes means for biasing the covers of the accessed binder 10, or 10' relative to the back of the non-accessed binder upon completion of access to such binder. The cover biasing means comprise a pair of plungers, as 70, and a pair of springs, as 71, generally coil-shaped, each connected to a plunger 70, and each encased in a casing, as 72, such that plunger 70 projects therefrom, which casings are secured to the second plate 21 at locations opposite the locations of the binders 10 and 10' in stored position.

Initially, the binders 10, 10' are properly positioned relative to the shelf 11, for convenient accessibility thereto and to the telephone directories enclosed therein, upon completion of storage of the binders 10, 10' by the plate movement stopping means, pursuant to which the rubber bumper 60, which extends from the plate 20, engages the second plate 21 upon movement of the binders 10, 10' to stored position.

In such initial condition, the binders 10, 10' are maintained closed, to protect the telephone directories enclosed therein from damage due to vandalism or exposure thereof to weather conditions, by the binder closing means, pursuant to which the rod 50, which extends from the plate 20, engages the cover of binder 10', upon movement of the binders 10, 10' to stored position, and urges such cover of binder 10' into contact with other cover of binder 10' and the covers of the binders 10, so as to close the covers of binders 10, 10'.

The user may obtain access to the binders 10, 10' and to the telephone directories enclosed therein, by pulling the second plate 21 in a generally clockwise rotational movement thereof through a substantially off-horizontal plane about the rod 23, and then pulling the desired binder 10 or 10' through a substantially off-vertical plane about the rod 40, to a readable position thereof as illustrated in FIG. 3, to enable access to the binders 10, 10' in a convenient and efficient manner. In such readable position of one of the binders, as 10, the inside cover of such binder 10 would bear against and urge the back portion of the partially accessed binder 10' against the second plate 21, which could subject such cover and/or binder 10' to damage thereto. The binders 10, 10' are protected from such damage by the cover biasing means, pursuant to which the plungers, as 70, urged by the springs, as 71, bear against and urge the binder, as 10', out of contact with second plate 21, to prevent damage to the partially accessed binder, to prevent damage to the inside cover of the accessed binder, to absorb the impact of return of the accessed binder to stored position, and to facilitate return of the accessed binder to stored position.

The user may store the binders 10, 10', by releasing the previously accessed binder, as 10, whereby such binder falls through a substantially off-vertical plane about the rod 40, and automatically the second plate 21 rotates through a substantially off-horizontal plane about the rod 23, to a position where the rubber bumper 60 contacts the plate 20 and the rod 50 contacts the binder 10' to enable storage of the binders 10, 10' in a convenient and efficient manner.

The preferred embodiment of the invention has been set forth herein. However, it is to be understood that variations may be made in such preferred embodiment, which variations may nevertheless be within the scope and spirit of the invention. The invention is therefore to be broadly construed, within the scope and spirit of the claims.

I claim:

1. An apparatus for enabling access to and automatic storage upon release of a binder relative to a support, comprising:

(a) means for enabling initial movement for access to and final movement for automatic storage of the binder relative to the support in a substantially off-horizontal plane; and (b) means for enabling initial movement for automatic storage upon release of and final movement for access to the binder relative to the support in a substantially off-vertical plane, connected to the substantially off-horizontal plane movement enabling means.

2. An apparatus as in claim 1, in which the substantially off-horizontal plane movement enabling means comprise a plate, having an opening therein proximate one corner thereof, and a rod, which extends through the opening in the plate, securable at one end thereof to the support at an obtuse included angle therewith, including a retainer at the other end thereof for retaining the rod on the plate.

3. An apparatus as in claim 1, in which the substantially off-vertical plane movement enabling means comprise a first bracket, generally U-shaped, including end portions having aligned openings therein, means for connecting the first aligned openings therein, means for connecting the first bracket to the binder substantially off-horizontal movement enabling means, a second bracket, generally U-shaped, including end portions having aligned openings therein, secured to binder back portion, and a rod, which extends through the aligned openings in the end portions of the first and second brackets.

4. An apparatus as in claim 1, further comprising means for stopping movement of the movable plate in the substantially off-horizontal plane relative to the support.

5. An apparatus as in claim 1, further comprising means for biasing the covers of the accessed binder relative to the back of the non-accessed binder.

6. An apparatus as in claim 3, in which the substantially off-horizontal plane movement enabling means includes a plate, having an opening therein proximate one corner thereof, and in which the first bracket connecting means comprise means for securing the first bracket to the plate proximate the side edge thereof opposite the corner in which the opening is located.

7. An apparatus as in claim 4, in which the plate movement stopping means comprise a bumper, secured to the plate, which extends to a position where the plate is engageable therewith upon movement of the binder to stored position.

8. An apparatus as in claim 5, in which the biasing means comprises a plunger, a spring, generally coil-shaped connected to the plunger, and a casing in which the plunger and rod are encased, securable at one end to the plate at a location opposite the location of the binder in stored position.

9. An apparatus as in claim 1, further comprising means for closing the binder upon automatic storage thereof.

10. An apparatus for enabling access to and automatic storage upon release of one of a plurality of binders relative to a support, comprising:

(a) means for enabling initial movement for access to and final movement for automatic storage of the binder relative to the support in a substantially off-horizontal plane; and (b) means for enabling initial movement for automatic storage upon release of and final movement for access to the binder relative to the support in a substantially off-vertical plane, connected to the substantially off-horizontal plane movement enabling means.

11. An apparatus as in claim 10, further comprising means for closing a second binder upon automatic storage thereof.

12. An apparatus as in claim 11, in which the second binder closing means comprise a rod, secured at one end to the support, the opposite end of which extends to a position where it engages a first binder which, in turn, bears against the second binder to urge said second binder closed upon automatic storage thereof.

13. An apparatus as in claim 9, in which the binder closing means comprise a rod, secured at one end to the plate, the opposite end of which extends to a position where it engages the binder upon automatic storage thereof.

* * * * *